US005442186A

United States Patent [19]

Walker et al.

[11] Patent Number: 5,442,186

[45] Date of Patent: Aug. 15, 1995

[54] RADIOACTIVE SOURCE RE-ENCAPSULATION INCLUDING SCORED OUTER JACKET

[75] Inventors: William F. Walker, Raleigh; Peter D. Muse, Durham, both of N.C.

[73] Assignee: Troxler Electronic Laboratories, Inc., Research Triangle Park, N.C.

[21] Appl. No.: 163,349

[22] Filed: Dec. 7, 1993

[51] Int. Cl.[6] ..... G21F 5/00

[52] U.S. Cl. ..... 250/506.1; 376/272; 220/254

[58] Field of Search ..... 250/493.1, 505.1, 506.1, 250/507.1; 220/254; 376/272

[56] References Cited

U.S. PATENT DOCUMENTS

| | | | |
|---|---|---|---|
| 475,890 | 5/1892 | Ramsey | 220/626 |
| 697,627 | 4/1902 | Johns et al. | 220/627 |
| 2,169,395 | 8/1939 | Rheem | 220/561 |
| 2,887,244 | 5/1959 | Betner | 220/626 |
| 3,199,712 | 8/1965 | Nurkiewicz | 220/626 |
| 3,256,441 | 6/1966 | Grasby | 250/506.1 |
| 3,588,031 | 6/1971 | Howard et al. | 250/506.1 |
| 3,659,107 | 4/1972 | Selle et al. | 250/506.1 |
| 4,567,014 | 1/1986 | Popp et al. | 250/506.1 |
| 4,569,818 | 2/1986 | Popp et al. | 250/506.1 |
| 4,572,952 | 2/1986 | Popp et al. | 250/506.1 |
| 4,594,214 | 6/1986 | Popp et al. | 250/506.1 |
| 4,654,171 | 3/1987 | Boncoeur et al. | 250/506.1 |
| 4,754,894 | 7/1988 | Simon et al. | 250/506.1 |
| 4,818,878 | 4/1989 | Popp et al. | 250/507.1 |
| 4,825,088 | 4/1989 | Nair et al. | 250/506.1 |
| 5,064,575 | 11/1991 | Madle et al. | 250/506.1 |

*Primary Examiner*—Jack I. Berman
*Assistant Examiner*—James Beyer
*Attorney, Agent, or Firm*—Bell, Seltzer, Park & Gibson

[57] ABSTRACT

A source capsule containing a radioactive isotope is put inside of an outer protective jacket or capsule and the outer jacket is sealed. The outer protective jacket is so designed that it can be reopened without disturbing the radioactive isotope source capsule contained therein. Thus, when it becomes necessary to recondition the source capsule, the inner source capsule can be removed from the outer protective jacket and it can be re-encapsulated in another outer protective jacket. There is provided an encapsulated radioactive isotope source which comprises an outer protective jacket in the form of a can having a side wall, an integrally formed bottom wall and an open upper end. A source capsule containing a radioactive isotope is received within this outer protective jacket. A jacket cap is received within the outer protective jacket so as to close the open end of the jacket, with the source capsule thus located within the outer protective jacket. The jacket cap has its outer peripheral edge positioned in close fitting relation to the inner peripheral surface of the jacket side wall to form a narrow gap between the jacket cap and the jacket side wall. A weld extends along the narrow gap to join the jacket cap to the jacket and to seal the source capsule within the protective jacket.

14 Claims, 1 Drawing Sheet

RADIOACTIVE SOURCE RE-ENCAPSULATION INCLUDING SCORED OUTER JACKET

FIELD AND BACKGROUND OF THE INVENTION

This invention relates to a radioactive isotope source, and more particularly to an encapsulated radioactive isotope source which is designed to permit re-encapsulation and reuse of the radioactive isotope.

Various types of analytical instruments use a radioactive isotope source in order to obtain measurements of the physical characteristics or properties of a test specimen. For example, there are commercially available instruments which use a radioactive isotope source for measuring properties such as density, composition, moisture content, thickness, etc. Examples of such test instruments are described in the following United States patents owned by applicants' assignee: U.S. Pat. Nos. 4,525,854; 4,542,472; 4,587,623; 4,766,319; 4,874,950; 4,979,197; and 5,155,356.

In nuclear instruments of the general type illustrated by the above patents, the radioactive isotopes are typically contained in a capsule. For example, where the isotopes are americium and beryllium, small pellets of the americium and beryllium are packaged in a stainless steel capsule.

Even though the radioactive half-life of these isotopes is very long (e.g. over 400 years) it is often recommended that the instruments be returned to the manufacturer periodically so that the radioactive isotope source can be reconditioned or replaced. This is because the weld in the stainless steel capsule may lose strength or become brittle after a number of years.

In the past, used radioactive isotope source capsules were collected and sent to a disposal site for radioactive materials. However, it has become increasingly difficult to find disposal sites which will accept such radioactive materials.

SUMMARY OF THE INVENTION

The present invention provides a way to re-encapsulate and thus reuse radioactive isotope source capsules. Specifically, in accordance with the present invention a source capsule containing a radioactive isotope is put inside of an outer protective jacket or capsule and the outer jacket is sealed. The outer protective jacket is so designed that it can be reopened without disturbing the radioactive isotope source capsule contained therein. Thus, when it becomes necessary to recondition the source capsule, the inner source capsule can be removed from the outer protective jacket and it can be re-encapsulated in another outer protective jacket. Because of the long radioactive half-life of the isotopes employed, the source capsules can be re-encapsulated as many times as may be needed, thus avoiding the problems associated with disposal of the radioactive isotopes. Furthermore, the ability to reuse the radioactive isotope source allows for recycling and thus an overall reduction in the number of sources produced.

In accordance with one embodiment of the present invention, there is provided a re-encapsulated radioactive isotope source which comprises an outer protective jacket in the form of a can having a side wall, an integrally formed bottom wall and an open upper end. A source capsule containing a radioactive isotope is received within this outer protective jacket. A jacket cap is received within the outer protective jacket so as to close the open end of the jacket, with the source capsule thus located within the outer protective jacket. The jacket cap has its outer peripheral edge positioned in close fitting relation to the inner peripheral surface of the jacket side wall to form a narrow gap between the jacket cap and the jacket side wall. A seal, such as a weld, extends along the narrow gap, joining the jacket cap to the jacket and sealing the source capsule within the protective jacket.

In a preferred embodiment, the axial length of the jacket is greater than the axial length of the source capsule and a removable spacer is positioned within the jacket filling the space between the source capsule and the jacket cap. A score line is provided on the outside surface of the jacket in the region of the underlying spacer to facilitate reopening the outer jacket without risk of damage to the original source capsule.

When it becomes necessary to recondition the source by re-encapsulation, the protective outer jacket is reopened and the original source capsule is removed from the jacket. The source capsule and a new spacer are then positioned within another outer protective jacket in the form of a can having a side wall, an integrally formed bottom wall and an open upper end. Another jacket cap is positioned within the outer protective jacket so as to close the open end of the jacket with the source capsule being located within the jacket. The jacket cap has its outer peripheral edge positioned in close fitting relation to the inner peripheral surface of the jacket side wall to form a narrow gap between the jacket cap and the jacket side wall. A seal is formed extending along the narrow gap to join the jacket cap to the jacket and to seal the source capsule within the protective jacket.

BRIEF DESCRIPTION OF THE DRAWINGS

Some of the features and advantages of the invention having been described, others will become apparent from the detailed description which follows, and from the accompanying drawings, in which.

DESCRIPTION OF THE ILLUSTRATED EMBODIMENTS

Figure 1:
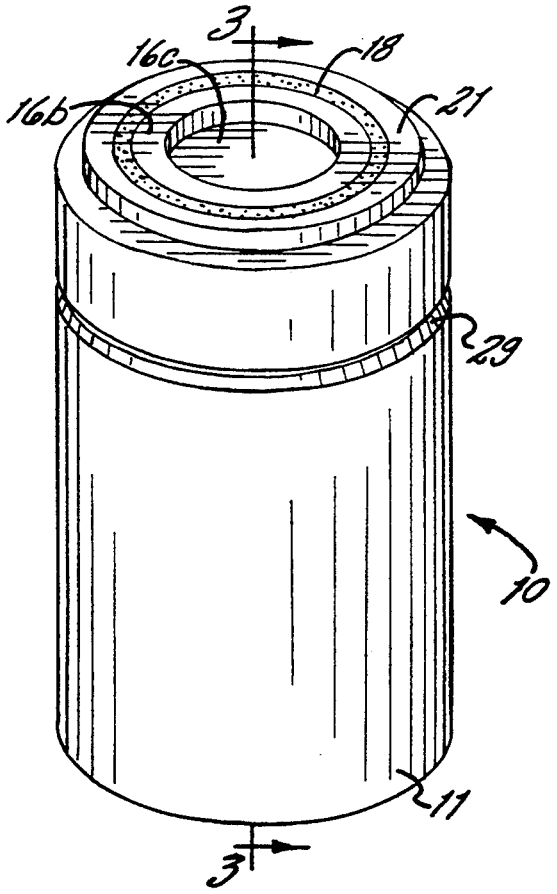
FIG. 1 is a perspective view showing a re-encapsulated radioactive isotope source in accordance with the present invention.

Referring now more particularly to the drawings, a re-encapsulated radioactive isotope source is indicated generally in FIG. 1 by the reference character 10. The source 10 includes an outer protective jacket 11 which is preferably made of a metal, such as stainless steel. As shown more fully in FIG. 3, the protective jacket 11 is in the form of a cylindrical can and includes a cylindrical side wall 11*a* and an integrally formed bottom wall 11*b*.

Figure 2:
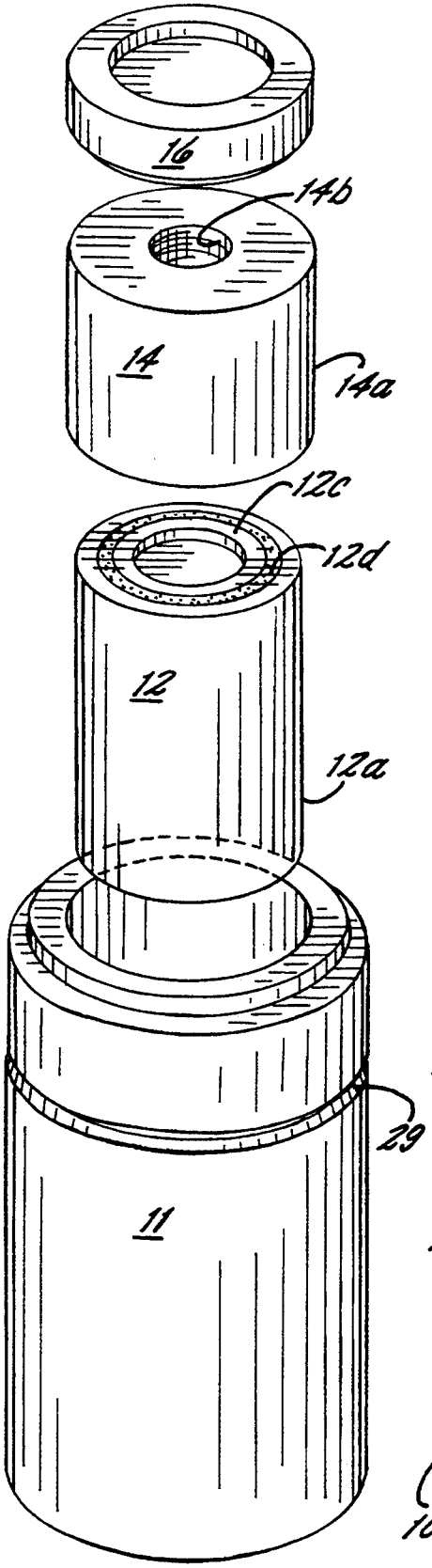
FIG. 2 is an exploded perspective view thereof.
Figure 3:
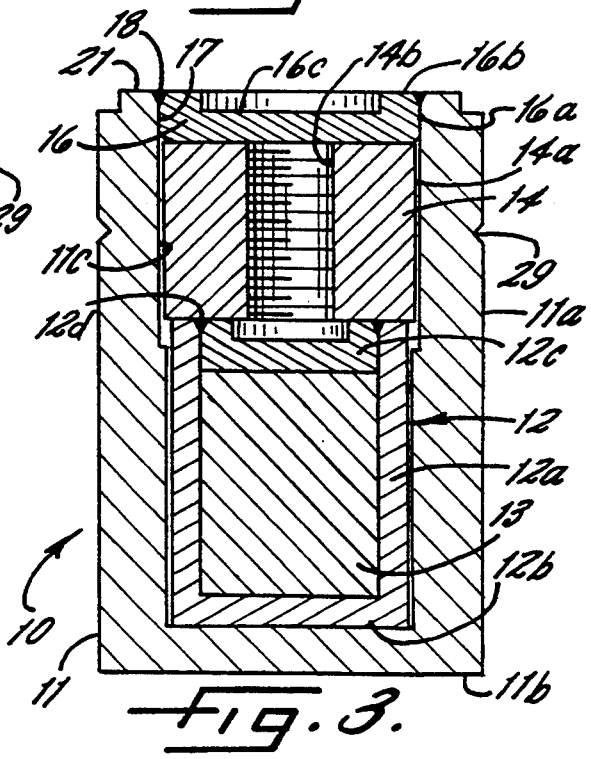
FIG. 3 is a cross-sectional view of the re-encapsulated source taken along the line 3—3 of FIG. 2.

As seen from FIGS. 2 and 3, a cylindrical source capsule 12 is positioned within the outer jacket 11. The source capsule 12 is of a cylindrical configuration of a diameter only slightly smaller than the inside diameter of the jacket 11 so that it readily fits within the protective jacket. The capsule 12 includes a cylindrical can-shaped outer shell including a cylindrical side wall 12*a*, an integrally formed bottom wall 12*b* and a lid or cap 12*c* joined to the side wall by a weld 12*d*. A radioactive isotope 13 is sealed within the capsule. The bottom wall 12*b* of the capsule abuts the inner surface of the bottom wall 11*b* of the protective jacket and at the opposite end the cap 12*c* of the capsule faces the open end of the jacket.

Overlying the source capsule 12 is a spacer plug 14. In the embodiment illustrated, the spacer plug is of a cylindrical configuration, with a diameter just slightly smaller than the inner diameter of the jacket so that outer peripheral surface 14*a* of the spacer plug is positioned in close fitting relation to the inner peripheral surface of the cylindrical side wall 11*a*. The spacer 14 has a hole 14*b* extending axially therethrough which may be threaded to facilitate removal of the spacer. Preferably, the spacer is made of a relatively high-melting material, such as ceramic or refractory, so that it will be unaffected by welding and will remain readily removable from the jacket 11.

The re-encapsulated radioactive isotope source 10 is capped and sealed by a cylindrical jacket cap 16. The jacket cap 16 is preferably formed of the same metallic material as the outer protective jacket 11 and has an outside diameter substantially corresponding to the inside diameter of the outer jacket. Thus, the outer circumferential surface 16*a* of the jacket cap is positioned in opposing, closely fitting relation to the inner peripheral surface of the jacket side wall 11*a*, with a narrow annular gap 17 being formed therebetween. A seal 18 overlies the annular gap 17 and forms an airtight, watertight closure, thus securing the jacket cap 16 to the jacket 11. The seal 18 is preferably formed by a weld, although other sealing methods such as brazing, epoxy, adhesives, etc. could be suitably employed.

The outward facing surface of the jacket cap 16 has a raised perimeter portion 16*b* with a planar surface and a recessed outward facing central portion 16*c* surrounded by the perimeter portion 16*b*. The raised perimeter portion 16*b* of the cap and the endmost facing edge portion 21 of the cylindrical side wall 11*a* defines surfaces which are in substantial alignment with each other and collectively form a raised annular shoulder at one end of the source 10. To facilitate obtaining a good strong weld and an effective seal, it is preferred that there be a V-shaped recess along the annular gap 17 to receive the weld. Thus, as best seen in FIG. 3, the juncture between the exposed outward facing surface of 16*a* of the jacket cap and the adjoining outer peripheral edge surface of the raised portion 16*b* forms a chamfered corner. Similarly, the juncture between the exposed endmost surface 21 of the jacket side wall 11*a* and the adjoining inner peripheral surface 11*c* of the side wall also forms a chamfered corner.

Once the encapsulated radioactive isotope source 10 has served its expected service life, it can be readily reconditioned by reopening the sealed re-encapsulating jacket, removing the existing source capsule 12 and by re-encapsulating it in a new outer protective jacket 11, with a new spacer plug 14 and a new jacket end cap 16 and a new weld 18. To facilitate reopening the jacket, a score line 29 is formed on the exterior of the cylindrical side wall 11*a* of the jacket at a location opposite the underlying spacer plug 14. A tubing cutter can be used to sever the side wall 11*a* along the score line 29. The presence of the spacer plug 14 assures that the cutting of the jacket 11 does not affect the source capsule 12. The cap 16 and the spacer plug 14 can thereupon be removed from the jacket 11 allowing the source capsule 12 to be removed. The threaded hole in the spacer can be used to facilitate removal of the spacer from the jacket. The source capsule 12 can then be re-encapsulated by placing in another outer protective jacket as previously described.

That which we claim is:

1. An encapsulated radioactive isotope source which permits re-encapsulation and reuse of the radioactive isotope and which comprises:

an outer protective jacket in the form of a can having a side wall, an integrally formed bottom wall and an open upper end;

a source capsule containing a radioactive isotope, said source capsule being received within said outer protective jacket;

a jacket cap received within said outer protective jacket so as to close the open end of said jacket, with said source capsule located therewithin, said jacket cap having its outer peripheral edge positioned in close-fitting relation to the inner peripheral surface of said jacket side wall to form a narrow gap between the jacket cap and said jacket side wall;

a score line formed on the exterior of said outer protective jacket; and a seal extending along said narrow gap to join said jacket cap to said jacket and to seal said source capsule within the protective jacket.

2. A source according to claim 1 additionally including a spacer plug located within said jacket between said source capsule and said jacket cap.

3. A source according to claim 2 wherein said spacer plug has a cross-sectional area substantially corresponding to the inside dimensions of said jacket and has its outer periphery positioned in close-fitting relation to the inner peripheral surface of said jacket side wall.

4. A source according to claim 2 wherein said score line is formed on the exterior of said outer protective jacket at a location opposite the underlying spacer plug.

5. A source according to claim 1 wherein the juncture between the exposed outward facing surface of said jacket cap and the adjoining outer peripheral edge surface of said jacket cap forms a V-shaped recess along said narrow gap, and wherein said seal comprises a weld located within said V-shaped recess.

6. A source according to claim 1 wherein the exposed outward facing surface of said jacket cap includes an outward facing raised perimeter portion where said weld contacts the jacket cap and a recessed outward facing central portion surrounded by said perimeter portion.

7. An encapsulated radioactive isotope source which permits re-encapsulation and reuse of the radioactive isotope and which comprises:

an outer cylindrical protective metallic jacket in the form of a can having a cylindrical side wall, an integrally formed bottom wall and an open upper end;

a source capsule containing a radioactive isotope, said source capsule being received within said outer protective jacket with one end thereof facing said bottom wall of the jacket and with an opposite end thereof facing said open upper end thereof;

a spacer plug received within said outer protective jacket overlying said opposite end of said source capsule;

a score line formed on the exterior of said outer protective jacket at a location opposite the underlying spacer plug;

a cylindrical jacket cap received within said outer protective jacket overlying said spacer plug, said jacket cap having its outer peripheral edge surface positioned in close-fitting relation to the inner peripheral surface of said jacket side wall to thereby close the open end of said jacket and to form a narrow annular gap between the jacket cap and the axially endmost surface of the side wall of said protective jacket; and a weld extending along and filling said narrow annular gap to join said cylindrical jacket cap to said outer protective jacket and to thereby seal the protective jacket.

8. A source according to claim 7 wherein said spacer plug is of a cylindrical configuration and has its outer circumferential surface positioned in close-fitting relation to the inner peripheral surface of said side wall.

9. A source according to claim 7 wherein the juncture between the exposed outward facing surface of said jacket cap and the adjoining outer peripheral edge surface of said jacket cap forms a chamfered corner defining one side of said gap, and the juncture between the exposed end surface of said jacket side wall and the adjoining inner peripheral surface of said jacket side wall forms a chamfered corner defining the other side of said gap, said chamfered corners being in substantial alignment with one another along said gap and forming a V-shaped recess, and said weld is located within said V-shaped recess.

10. A method of re-encapsulating and reusing a radioactive isotope source which comprises:

positioning a source capsule containing a radioactive isotope within an outer protective jacket in the form of a can having a side wall, an integrally formed bottom wall, a score line formed on the exterior of said outer protective jacket, and an open upper end;

positioning a jacket cap within said outer protective jacket so as to close the open end of said jacket with said source capsule located therewithin, said jacket cap having its outer peripheral edge positioned in close-fitting relation to the inner peripheral surface of said jacket side wall to form a narrow gap between the jacket cap and said jacket side wall; and forming a seal extending along said narrow gap to join said jacket cap to said jacket and to seal said source capsule within the protective jacket.

11. A method according to claim 10 additionally including positioning a spacer plug within said jacket between said source capsule and said jacket cap.

12. A method according to claim 10 including the steps of separating the jacket cap from said jacket to reopen the protective jacket, removing the source capsule from said jacket, and carrying out the following steps with a new protective jacket and a new jacket cap to re-encapsulate said source capsule:

positioning said source capsule containing a radioactive isotope within another outer protective jacket in the form of a can having a side wall, an integrally formed bottom wall, a score line formed on the exterior of said outer protective jacket, and an open upper end;

positioning another jacket cap within said another outer protective jacket so as to close the open end of said jacket with said source capsule located therewithin, said another jacket cap having its outer peripheral edge positioned in close-fitting relation to the inner peripheral surface of said jacket side wall to form a narrow gap between the jacket cap and said jacket side wall; and forming a seal extending along said narrow gap to join said jacket cap to said jacket and to seal said source capsule within the protective jacket.

13. A method of re-encapsulating and reusing a radioactive isotope source which comprises:

positioning a source capsule containing a radioactive isotope within an outer cylindrical protective metallic jacket in the form of a can having a cylindrical side wall, an integrally formed bottom wall, a score line formed on the exterior of said outer protective jacket, and an open upper end, with one end of the source capsule facing said bottom wall of the jacket and with an opposite end thereof facing said open upper end thereof;

positioning a spacer plug within said outer protective jacket overlying said opposite end of said source capsule;

positioning a cylindrical jacket cap within said outer protective jacket overlying said spacer plug, said jacket cap having its outer peripheral edge surface positioned in close-fitting relation to the inner peripheral surface of said jacket side wall to thereby close the open end of said jacket and to form a narrow annular gap between the jacket cap and the axially endmost surface of the side wall of said protective jacket; and forming a weld extending along said narrow annular gap to join said jacket cap to said jacket and to seal said source capsule within the protective jacket.

14. A method according to claim 13 including the steps of separating the jacket cap from said jacket, removing the source capsule from said jacket, and carrying out the following steps with a new protective jacket and a new jacket cap to re-encapsulate said source capsule:

positioning a source capsule containing a radioactive isotope within another outer cylindrical protective metallic jacket in the form of a can having a cylindrical side wall, an integrally formed bottom wall, a score line formed on the exterior of said outer protective jacket, and an open upper end, with one end of the source capsule facing said bottom wall of the jacket and with an opposite end thereof facing said open upper end thereof;

positioning a spacer plug within said another outer protective jacket overlying said opposite end of said source capsule;

positioning another cylindrical jacket cap within said outer protective jacket overlying said spacer plug, said jacket cap having its outer peripheral edge surface positioned in close-fitting relation to the inner peripheral surface of said jacket side wall to thereby close the open end of said jacket and to form a narrow annular gap between the jacket cap and the axially endmost surface of the side wall of said protective jacket; and forming a weld extending along said narrow annular gap to join said jacket cap to said jacket and to seal said source capsule within the protective jacket.

* * * * *

UNITED STATES PATENT AND TRADEMARK OFFICE

CERTIFICATE OF CORRECTION

PATENT NO. : 5,442,186

DATED : August 15, 1995

INVENTOR(S) : Walker et al

It is certified that error appears in the above-indentified patent and that said Letters Patent is hereby corrected as shown below:

On the title page, item [56] References Cited

Line 8, "Grasby" should be --Grasty--.

Line 13, "4,572,952" should be --4,572,959--.

Signed and Sealed this

Seventh Day of November, 1995

*Attest:*

*Attesting Officer*

BRUCE LEHMAN

*Commissioner of Patents and Trademarks*